US005217622A

United States Patent [19]

Flores

[11] Patent Number: 5,217,622

[45] Date of Patent: Jun. 8, 1993

[54] PROCESS AND APPARATUS FOR TREATMENT OF CEMETARY LIQUIDS, GASES AND VAPORS FROM STANCH INTERMENT UNITS

[76] Inventor: José E. Flores, Rua Romana, 40, Porto Alegre - 90.000, Brazil

[21] Appl. No.: 914,472

[22] Filed: Jul. 17, 1992

[30] Foreign Application Priority Data

| | | | |
|---|---|---|---|
| Aug. 30, 1991 | [BR] | Brazil | PI 9103795 |
| Feb. 6, 1992 | [BR] | Brazil | 163/92 |
| Feb. 6, 1992 | [BR] | Brazil | 164/92 |

[51] Int. Cl.[5] ..... B01D 53/00; E04H 13/00; A61G 17/00

[52] U.S. Cl. ..... 210/747; 27/1; 52/130; 52/132; 52/134; 55/97; 55/270; 55/279; 55/315; 55/316; 55/355; 165/1; 210/170; 210/188; 210/513; 210/800; 422/4; 422/28; 422/169; 422/170; 422/173; 422/186.1

[58] Field of Search ..... 55/1, 97, 261, 270, 55/279, 315, 316, 342, 344, 355, 383, 462; 165/1; 210/188, 800, 248, 513; 27/1, 11; 52/129-136; 422/1, 4, 168, 169, 170, 173, 176, 22, 186.04

[56] References Cited

U.S. PATENT DOCUMENTS

| | | | |
|---|---|---|---|
| 1,059,552 | 4/1913 | Merkel | 52/130 |
| 1,234,740 | 7/1917 | Edwards | 52/132 |
| 3,938,287 | 2/1976 | Gauchard | 27/1 |

*Primary Examiner*—Joseph W. Drodge
*Attorney, Agent, or Firm*—Edmund M. Jaskiewicz

[57] ABSTRACT

An apparatus for the treatment of liquids, gases and vapors originating from water impervious interment units comprises a plurality of vertical passages in the vertical walls between units. The upper ends of the vertical passages are connected to an exhaust system and the lower ends of the vertical passages are connected to a drain passage for liquids. Gases drawn through the exhaust system are subjected to sterilization processes including burning and filtering such that any gases discharged into the atmosphere are free of pathogens and odors. A process is also disclosed for the treatment of gases and vapors from the units.

11 Claims, 5 Drawing Sheets

FIG.7
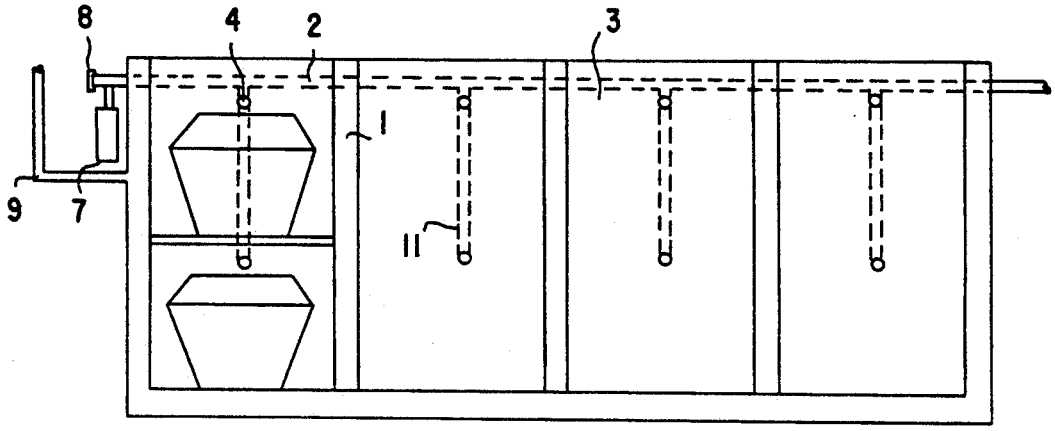
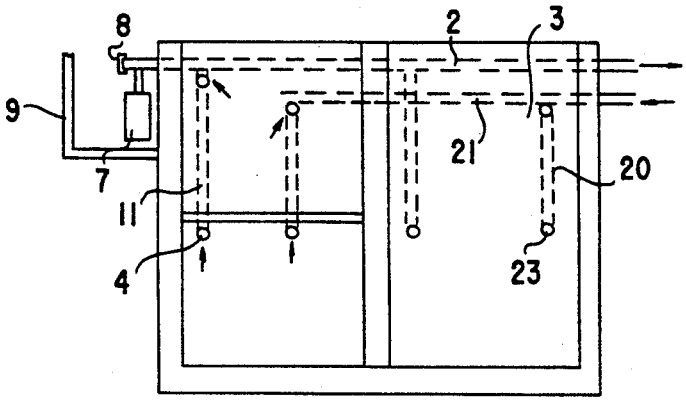
FIG.8
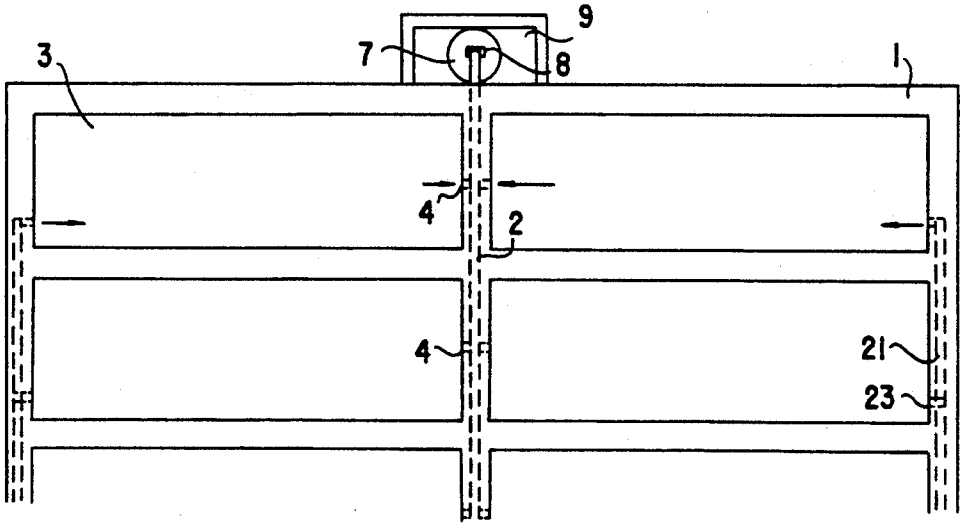
FIG.9

PROCESS AND APPARATUS FOR TREATMENT OF CEMETARY LIQUIDS, GASES AND VAPORS FROM STANCH INTERMENT UNITS

The present invention relates to the abatement of pollution originating from cemetaries, mortuaries, mausoleums and the like, more particularly, to an apparatus and process for the treatment of liquids, gases and vapors originating from interment units for the burial of the dead.

Largely because of religious and cultural reasons, very little attention has been directed to pollution originating from cemetaries, mortuaries or mausoleums for the permanent or temporary burial of the dead above or below ground. Because of the growing increase in population, cemetaries which were originally quite remote from population centers now are very close to densely populated areas. Further, because land is becoming more scarce for cemetaries near population centers, more and more attention has been directed toward mortuaries and other structures for the interment of the dead above ground. Even when cemetaries are originally planned to be located far from inhabited areas, the expanding of populated urban areas continues so that these cemetaries eventually find themselves surrounded by urban areas.

The natural decomposition of a corpse, even when buried in accordance with the rules and regulations of pertinent governmental bodies, may give rise to pollution in the form of pathogenic bacteria which may seep into the natural water table. Subsequently, such bacteria may be transmitted to wells and other bodies of water including streams, rivers, lakes and the like. If human beings make use of these bodies of water, the possibility arises that such bacteria could infect humans and subsequently cause diseases and under certain circumstances even originate epidemics.

One particular form of pollution is caused by insects and various small animals which can enter into caskets in a cemetary through existing cracks or fissures or by causing such cracks or fissures. Such insects or animals could then actually contact the remains in the casket or organic liquids which can filter through cracks or fissures from the interment unit. If such insects and animals come in contact with human remains whose death was due to infectious diseases, such diseases can then easily be transmitted and disseminated in areas far removed from the cemetary and could even be the focus of epidemics.

Another form of pollution occurs with the pollution of the air in the vicinity of the cemetary or mortuary by pathogenic bacteria suspended in the air. Such bacteria may result from gases originating from the decomposition of remains and cause unpleasant odors which cause discomfort to any persons who may be in or in the vicinity of the cemetary.

It is therefore the principal object of the present invention to provide a novel and improved process and apparatus for preventing pollution caused by liquids, gases and vapors originating from cemetaries and other structures for the permanent or temporary interment of the dead.

It is another object of the present invention to provide such an apparatus and process which effectively treats liquids, gases and vapors originating from interment units above or below ground.

According to one aspect of the present invention, an apparatus for the treatment of liquids, gases and vapors originating from water impervious interment units may comprise a network of vertical and horizontal passages formed in reinforced concrete horizontal and vertical walls which form a plurality of horizontally and vertically disposed interment units. The vertical passages each communicate with one or more interment units and any liquids originating in the units are conveyed through the vertical passages to a collecting passage formed in or below the lowermost horizontal wall of the unit. The liquid is collected and periodically disposed of by incineration or another suitable process. Gases and vapors are similarly collected through the vertical passages and are transmitted upwardly to a collecting passage formed in or above the uppermost horizontal wall of the interment units. These gases and vapors are them pumped through a sterilizer, burned, and subsequently filtered through an activated charcoal filter so that any gases released to the atmosphere are free of pathogenic germs and odors.

A distribution network of horizontal passages in the uppermost horizontal wall connected to vertical passages in the vertical walls of the units may be used to introduce air or other suitable gases into the interment units to expedite the decomposition process.

Other objects and advantages of the present invention will be apparent upon reference to the accompanying description when taken in conjunction with the following drawings, which are exemplary, wherein;

FIG. 7 is a horizontal sectional view of a plurality of underground interment units and showing an aspiration network connected to the unit;

FIG. 8 is a view of a portion of FIG. 7 and showing both aspiration and circulation networks to the units; and FIG. 9 is a horizontal sectional view of the plurality of units shown in FIG. 7 and illustrating the aspiration and circulation networks seen in FIGS. 7 and 8.

Proceeding next to the drawings wherein like reference symbols indicate the same parts throughout the various views a specific embodiment and modifications of the present invention will be described in detail.

Figure 1:
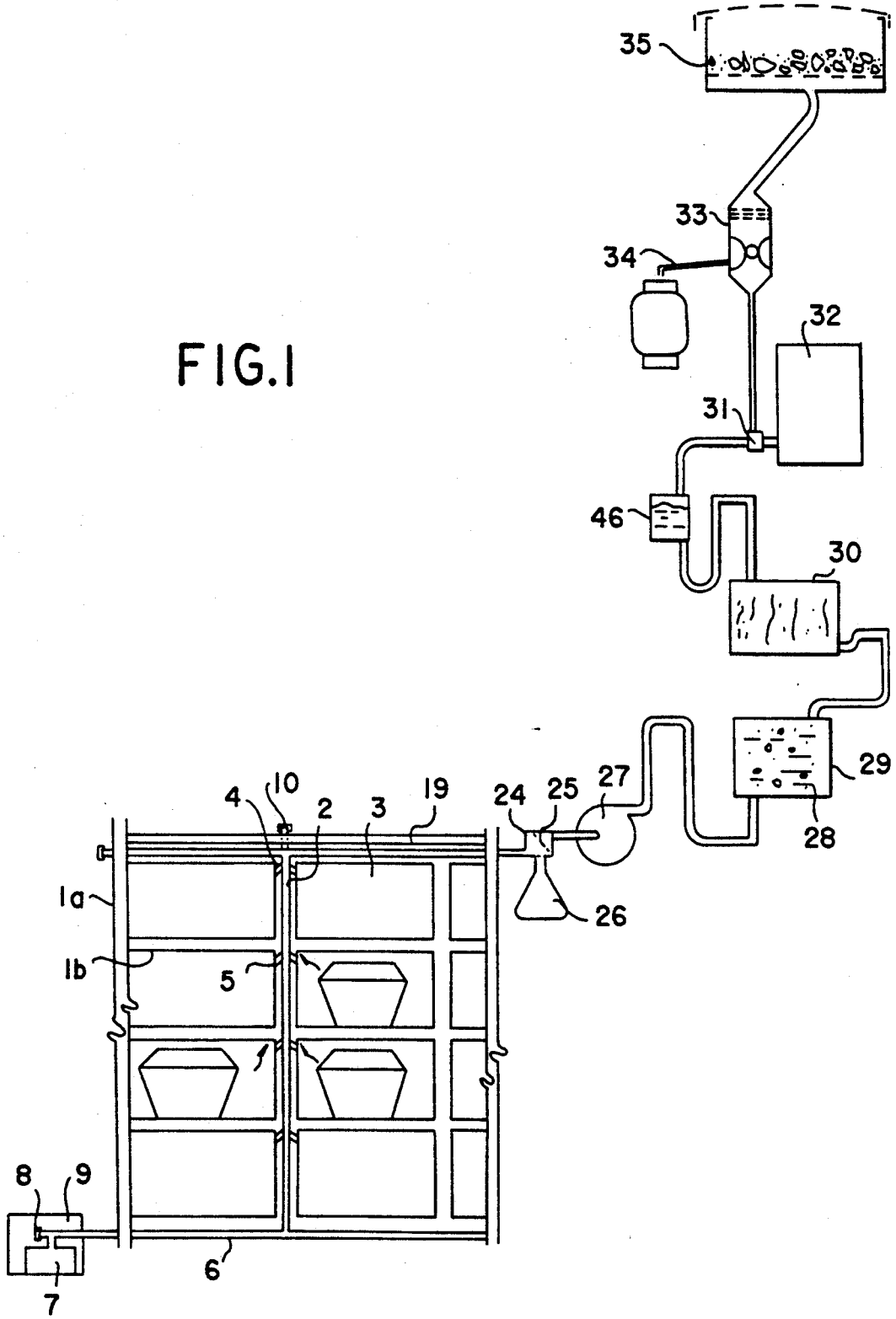
FIG. 1 is a schematic representation of the treatment apparatus connected to a plurality of interment units shown in a vertical sectional view.

As can be seen in FIG. 1, there is shown at 1 an assembly or plurality of interment units which are formed by a plurality of vertical walls 1*a* and horizontal walls 1*b* made of reinforced concrete which has been thoroughly vibrated so as to result in a solid concrete mixture with a minimum of voids therein. The horizontal and vertical walls 1*a* and 1*b* are assembled into interment units 3 .which in this particular embodiment are stacked four high for an indefinite length in the horizontal direction.

In a vertical wall between two vertical stacks of units 3 there is vertical tubing 2 which communicates through connecting passages 4 to each of the interment units 3. The tubing 2 may be withdrawn prior to total setting of the concrete so that they are used as forms and the result is the vertical passages. However, if desired, the tubing may remain embedded in the concrete walls and since they are in the interior of the concrete they are protected against rupture through accidents or from attacks by rodents or other animals.

The connecting passages 4 leading into each unit 3 are preferably closed with a suitable stopper, plug or tape 5 as long as the units are empty. The connecting passages are closed to avoid the entry of air into the system.

The vertical passages or tubing 2 are connected to a substantially horizontal drainage tubing or passage 6 which is somewhat inclined from the horizontal and at its end is connected to a box 9 in which there is placed a water impervious container 7 which collects any liquids that may accumulate in the passage system such as through condensation. The extreme end of the passage 6 is closed with a plug 8 which can be removed in order to permit the introduction of a rod, steel cable in order to periodically clean and maintain the drainage passage 6 open. The container 7 may also contain a bactericide substance and can be made of glass or other suitable transparent material so that the level of its contents can be observed. When necessary, the container 7 is removed and the contents are disposed of by incineration. After this use, the container is preferably sterilized and the drain passages cleaned. The drainage passage 6 is preferably located in the lowermost horizontal wall 1*b* or immediately below this horizontal wall.

The upper end of each vertical passage 2 is closed by a plug or stopper 10 which, upon removal, will permit the insertion of a suitable cleaning rod or cable. The vertical passage 2 functions as an aspiration or exhaust system and is connected to a horizontally disposed collecting passage 19 which is formed in the uppermost horizontal wall 1*b* of the plurality of units or in a position immediately above this horizontal wall. The collecting passage 19 is then connected to a treatment unit, which will be subsequently described in greater detail, and a vacuum or sub-atmospheric pressure is composed upon this system in order to continuously exhaust any gases emanating from the interment units 3. Further, the continuous exhausting of liquids and gases will also serve to expedite the composition of remains in the unit and thus presents the possibility of the same unit being used again after the bones from the remains are disposed of by cremation or placed in an ossuary.

When the interment units 3 are constructed below ground, the aspiration passage 19 slightly inclined with respect to the horizontal and is connected by vertical passages 11 to the lower units in the embodiment where there are double interment units as shown in FIG. 7. To expedite the composition of remains, air can be circulated to the interior of each unit through these passages for the purpose of making an interment unit available as soon as possible for a new burial.

Figure 6A:
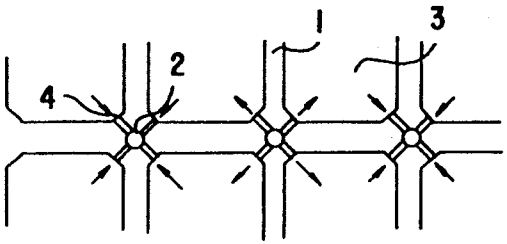
FIG. 6A is a portion of a sectional view taken along the line A—A in FIG. 5.
Figure 6:
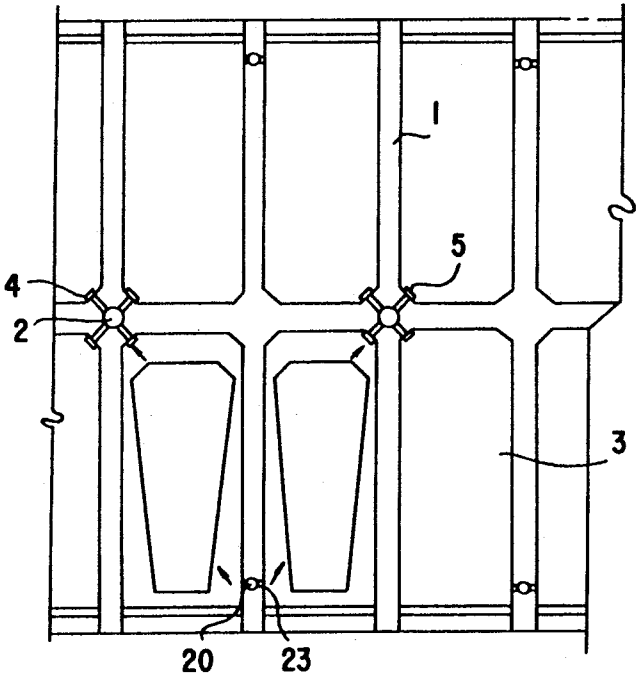
FIG. 6 is a horizontal sectional view of the units shown in FIG. 5.
Figure 5:
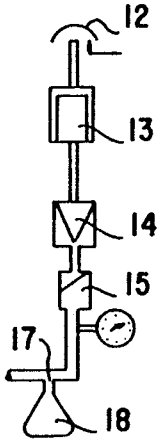
FIG. 5 is a vertical sectional view of a plurality of interment units provided with an air circulation network.
Figure 5:
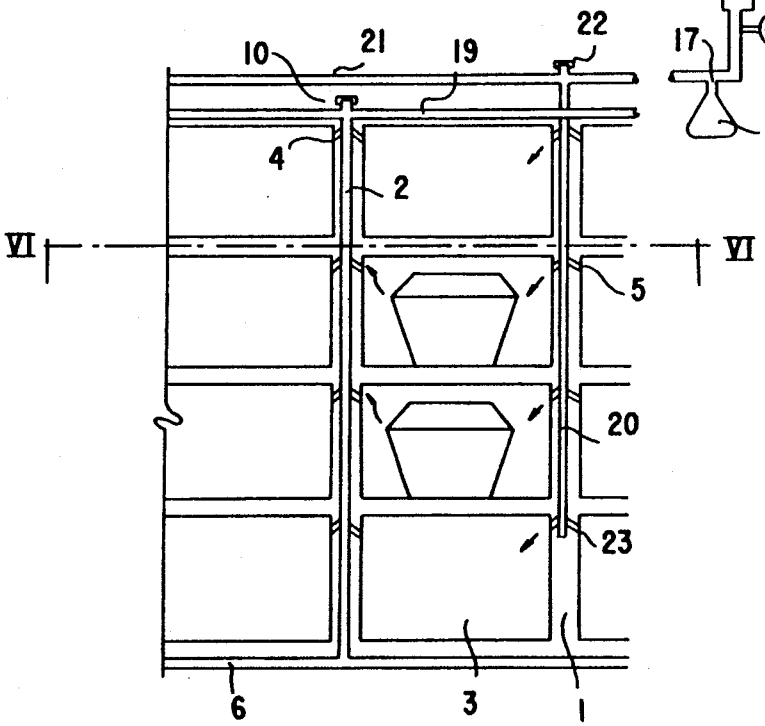

The system for circulating air through the units may be seen in FIG. 5 and comprises vertical circulation tubing or passages 20 within the vertical concrete walls and the upper ends of these vertical passages are connected to a substantially horizontal distribution passage or tubing 21. The upper ends of the vertical passages 20 may be extended above the distribution passages 21 and provided with a closure or plug which is removable for cleaning. The vertical circulation passages 20 are positioned adjacent to and immediately inwardly of the front opening of each unit through tubular connecting passages 23 as may be seen in FIG. 6. These passages 23 again can be closed by plugs, tapes or sealed bands 5 when the unit is not in use. It is preferred that the vertical circulation passages 20 be positioned in a vertical wall separating two interment units away from the end of the unit which is connected to the exhaust or aspiration tubing Z. Such an arrangement minimizes the amount of tubing required and is easier to construct even though its efficacy may be less than that of previously described embodiments. A somewhat similar construction can be employed in subterranean or underground interment units such as those illustrated in FIG. 7.

Connected to the distribution passage 21 and also constituting a component of the circulation system is an air intake 12 protected by a shield and opening into a thin metallic screen filter 13 to avoid the entrance or exit of undesirable substances and living matter. The filter 13 is then connected to a regulating pressure valve 14 which functions to maintain the negative pressure in the interior of the units at a predetermined level. Also provided in the circulation system is a check or unidirectional valve 15 which avoids the return of exhausted gases which may be replaced, if desired, by a water seal. A manometer may also be connected to the network below the valve 15 to provide a visual control or indication of the system.

In order to prevent any insects and small animal life from exiting the interment units through the circulation system and thereby damaging the valves, there is provided a chamber having a thin metallic screen 17 near the mouth of a glass conical shaped container 18 so that any animals or insects that are blocked by the screen are directed into the receiver 18 and do not escape through the system. The receiver 18 should be periodically cleaned and the contents thereof incinerated.

As may be seen in FIGS. 7-9, the connecting passages 4 and the connection segments 11 are positioned adjacent to one of the edges of an interment unit and the circulation passages 20 next to the other edges of the unit. According to the present invention, the distribution passages 21 and the circulation passages 20 can be positioned in opposed walls.

The collecting passages 19 as seen in FIG. 1, immediately outside of the interment units are connected in its initial portion to a chamber 24 in which is provided an inclined metallic screen 25 so as to entrap any insects or animal life which may be proceeding along the passage 19. A glass conical receiver or container 26 is positioned under the chamber 24 so as to collect and retain insects or animals blocked by the screen 25. The container 26 is periodically removed, cleaned and the contents incinerated.

The collection passage 19 which is a component of the exhaust or aspiration system comprises a pump 27 which draws the aspirated gases from the interment units 3 through a U-shaped trap and into a container 29 containing a bactericide 28 to sterilize the gases. Since these gases are rich in methane, particularly in large size cemetaries, these gases are conducted to a halogenizer 30 which will convert a portion of the methane into chloroform and will sterilize the remaining gases which will then pass through a water seal 46 through a valve 41 into a boiler 32 or upwardly into a burner 33 where the gases will be burned to eliminate remaining methane and to provide sterilization of the gases. Any gases which may remain are then conveyed through a charcoal filter 35 and then released into the atmosphere free of pathogens or odors.

The burner 33 is provided with a pilot frame which is continuously energized from a gas storage cylinder 34.

Figure 2:
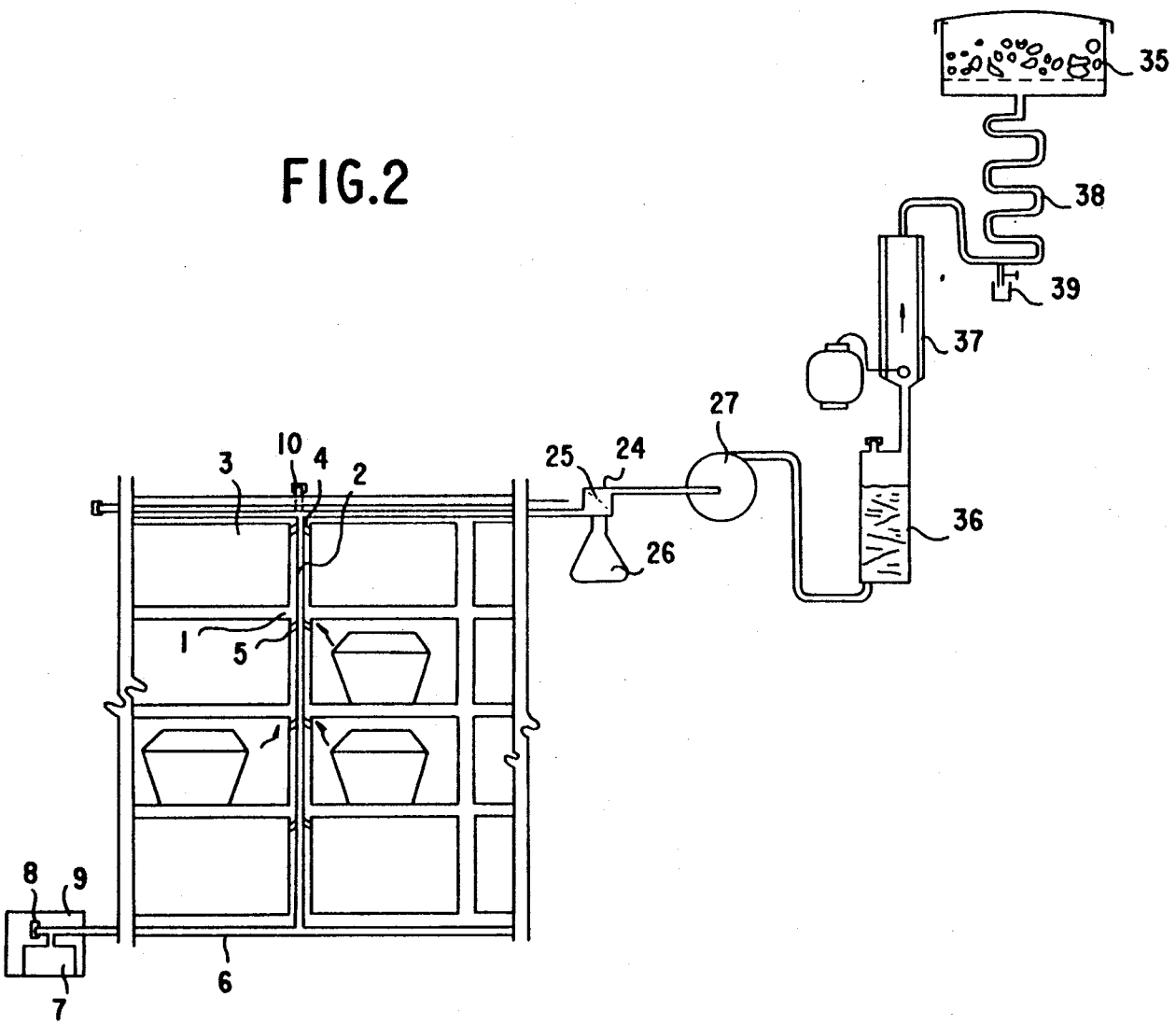
FIG. 2 is a view similar to that of FIG. 1 and showing the treatment apparatus with a sterilizer liquid and a burning flame.

A modification of the circulation system is shown in FIG. 2 wherein the aspiration or exhaust pump 27 discharges gases through a reservoir 36 which contains a bactericide and which also functions as a liquid seal to prevent explosions in the system. The gas is then passed into a thermally insulated burner 37 where the gases will be burned and the temperature of the burning gases may be raised with the aid of natural or propane gases or other liquid fuels in sufficient time and quantities to provide total sterilization of the gases. The heated gases are then passed through a cooling coil 38 which may have a serpentine pattern as shown or in a similar long straight pipe. The condensed liquids are then collected in a container 39 at the lower portion of the cooling coil and any remaining gases are liberated through an activated charcoal filter 35.

Figure 3:
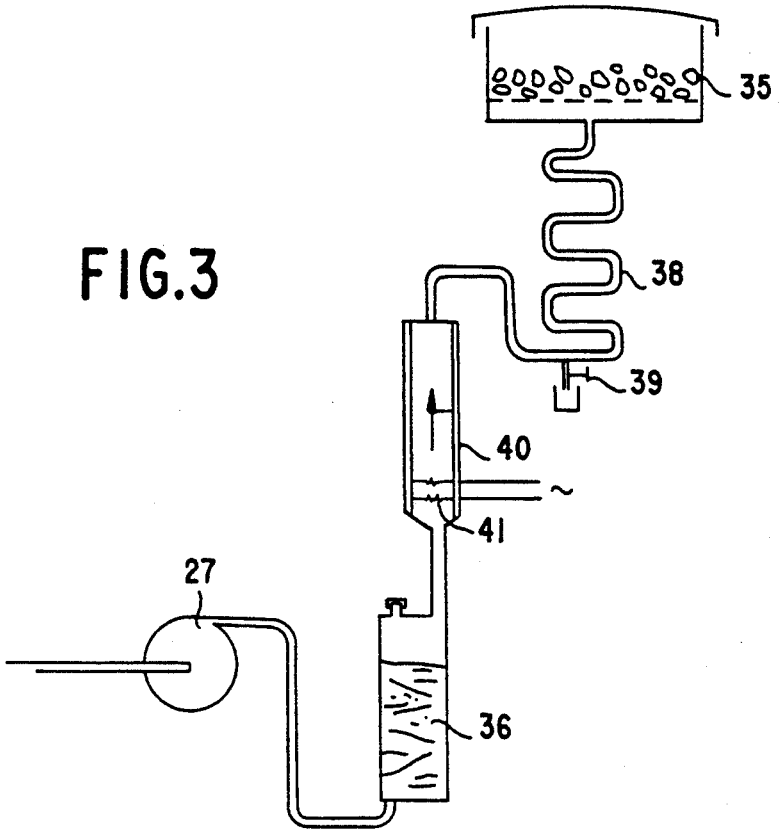
FIG. 3 is a schematic view of only the treatment apparatus as shown in FIG. 1 but using a bactericide liquid and incineration with electrical resistances.

In FIG. 3, there is shown a further modification in which there is provided a burner 40 having electrical resistances 41 therein which significantly raise the temperature of the burning gases so as to provide for complete sterilization of the gases.

Figure 4:
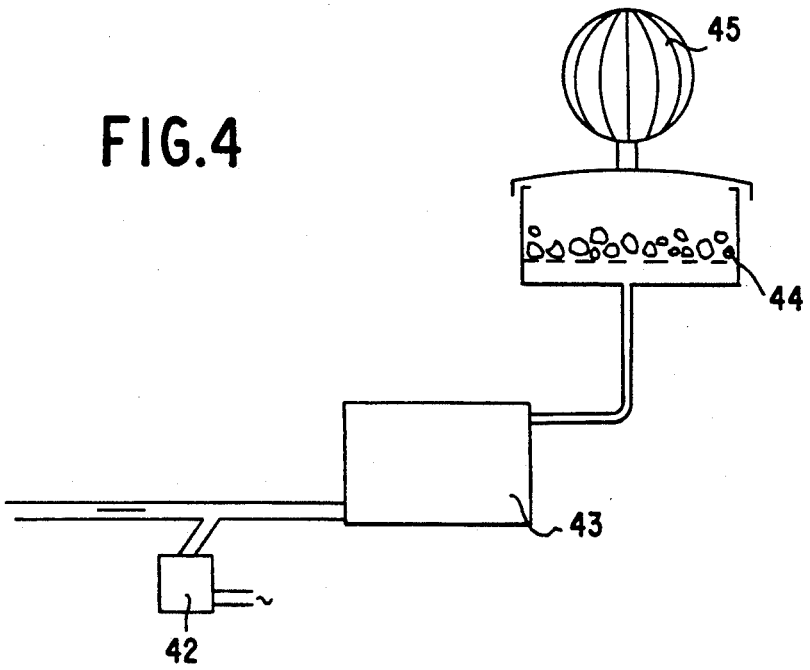
FIG. 4 is a view similar to that of FIG. 3 but showing the treatment apparatus using ozone or sterilizing gas.

In FIG. 4, there is shown a further modification wherein the exhausted gases may be sterilized by passing the gases through a unit 42 which may be an ozone generator or a doser of gases bactericides such as chlorinated or fluorinated gases. The entire mixture of gases is then conducted to a reaction chamber 43 and immediately passed through an activated charcoal filter 44. The gases are then aspirated through an exhaust or vent fan 45 and liberated into the atmosphere in a sterilized condition and without any odor.

For interment units which are positioned above ground, there can be provided underneath the units a waterproof drainage arrangement such that any liquids are drained and collected in a water impervious container disposed underneath the interment units. Such an arrangement will avoid any technical problems which may relate from liquid leakage from the interment units.

Thus it can be seen that the present invention has provided a simple yet effective procedure and apparatus for the treatment of any gases, vapors and liquids which may emanate from interment units located either above or below ground. The gases and vapors are collected and subjected to intensive sterilization such that any gases eventually discharged into the atmosphere are free of pathogens and odors. Any liquids from the interment units are collected in completely sealed structure and the collected liquids are periodically removed and incinerated.

It will be understood that this invention is susceptible to modification in order to adapt it to different usages and conditions, and accordingly, it is desired to comprehend such modifications within this invention as may fall within the scope of the appended claims.

What is claimed is:

1. An apparatus for the treatment of liquids, gases and vapors originating from water impervious interment units comprising a plurality of spaced reinforced concrete horizontal and vertical walls to define a plurality of horizontally and vertically disposed interment units, there being vertical passages in said vertical walls and connecting passages in an upper portion of each interment unit connected to a said vertical passage, there being a substantially horizontal drain passage in a lowermost horizontal wall of the units connected to said vertical passages, said drain passage having one end projecting from said interment units and a removable closure on said end, a first water impervious container for liquids connected to said drain passage adjacent said projecting one end, there being a substantially horizontal collecting passage for gases and vapors in an uppermost horizontal wall of the units connected with said vertical passages, said collecting passage having an end projecting from said interment units to a chamber having an inlet connected to said end, an inclined metal screen, a second container connected to an underside of said chamber below said screen, said chamber having an outlet and a pump having an intake connected to said chamber outlet, said pump having a discharge, and means connected to said pump discharge for separating solids from said gases and vapors received from said collecting passage while subsequently sterilizing and burning and filtering said gases and vapors such that any gases released to the atmosphere are free of pathogenic germs and odors.

2. An apparatus as claimed in claim 1 wherein said means connected to said pump discharge comprises a siphon having one end connected to said pump discharge, a receiver having a bactericide therein connected to another end of said siphon, a halogenizer having an inlet connected to an outlet of said bactericide receiver and further having an outlet connected to a water seal, a burner connected to said water seal to receive and burn gases passing through said water seal and further having a discharge, and an activated charcoal filter connected to said burner discharge.

3. An apparatus as claimed in claim 1 wherein said means connected to said pump discharge comprises a reservoir containing a bactericide connected to said pump discharge and having an outlet, a burner connected to said reservoir outlet and having a discharge, a tubular condensation coil having one end connected to said burner discharge and having a liquid collector connected to a lower portion of said coil, and an activated charcoal filter connected to another end of said coil.

4. An apparatus as claimed in claim 1 wherein said means connected to said pump discharge comprises a reservoir containing a bactericide connected to said pump discharge and having an outlet, a sterilizer connected to said reservoir outlet, thermal heating elements in said sterilizer, a tubular condensation coil having one end connected to said burner discharge and having a liquid collector connected to a lower portion of said coil, and an activated charcoal filter connected to another end of said coil.

5. An apparatus as claimed in claim 1 wherein said means connected to said pump discharge comprises a reaction chamber having an inlet connected to said pump discharge, one of an ozone generator or gaseous bactericide generator connected to said reaction chamber, said reaction chamber having a discharge and an activated charcoal filter connected to said reaction chamber discharge, and exhaust fan means connected to a discharge of said activated charcoal filter.

6. An apparatus as claimed in claim 1 wherein there is at least one assembly of two vertically disposed interment units and said units are buried in the earth, said collecting passage being inclined with respect to the horizontal, there being substantially vertical passages interconnecting each said two vertically disposed interment units with said collecting passage.

7. An apparatus as claimed in claim 1 and further comprising a substantially horizontal air distribution passage in said uppermost horizontal wall and a plurality of first vertical distribution passages in said vertical walls connected to said horizontal distribution passage and communicating with each of said interment units, and means for introducing and filtering air into said horizontal distribution passage.

8. An apparatus as claimed in claim 7 wherein said air introducing means comprises an air intake, a filter, a pressure regulator valve, a check valve and a manometer connected in series, and a screen and receiver connected to said horizontal air distribution passage after said manometer.

9. An apparatus as claimed in claim 7 and further comprising additional vertical distribution passages in said vertical walls spaced from said first vertical distribution passages and communicating with portions of said interment units remote from said first vertical distribution passages.

10. An apparatus as claimed in claim 1 and further comprising removable stopper means in said connecting passages opening into said interment units.

11. Process for the treatment of liquids, gases and vapors originating from a plurality water impervious interment units vertically and horizontally disposed above ground or in the ground comprising the steps of withdrawing gases and vapors from the interment units through vertical passages in vertical walls interconnected to a collecting passage in an uppermost horizontal wall of the plurality of units, withdrawing liquids from the units through vertical passages in vertical walls interconnected to a horizontal drain passage in a lowermost horizontal wall of the plurality of units, subjecting the withdrawn gases to sterilization, burning the sterilized gases and filtering any gases remaining after burning and discharging the filtered gases into the atmosphere free of pathogenic germs and odors.

* * * * *